US007389732B2

(12) United States Patent
Taylor

(10) Patent No.: US 7,389,732 B2
(45) Date of Patent: Jun. 24, 2008

(54) MECHANISM FOR SELECTIVELY OPERATING HOPPER DOORS OF A RAILROAD CAR

(76) Inventor: Fred J. Taylor, 6485 Rogers La., Burlington, KY (US) 41005

( * ) Notice: Subject to any disclaimer, the term of this patent is extended or adjusted under 35 U.S.C. 154(b) by 318 days.

(21) Appl. No.: 11/137,919

(22) Filed: May 26, 2005

(65) Prior Publication Data

US 2005/0263032 A1 Dec. 1, 2005

Related U.S. Application Data

(60) Provisional application No. 60/574,761, filed on May 27, 2004.

(51) Int. Cl.
*B61D 3/00* (2006.01)

(52) U.S. Cl. ..... 105/287; 105/286; 105/288; 105/311.2

(58) Field of Classification Search ..... 105/286, 105/287, 288, 311.2, 290, 293, 296, 299, 105/247, 248, 253, 280, 250, 2.51, 398, 284, 105/240

See application file for complete search history.

(56) References Cited

U.S. PATENT DOCUMENTS

| | | | | | |
|---|---|---|---|---|---|
| 3,675,590 | A | * | 7/1972 | Schuller | 105/240 |
| 3,772,996 | A | * | 11/1973 | Schuller | 105/240 |
| 4,132,177 | A | * | 1/1979 | Funk | 105/310 |
| 4,284,011 | A | * | 8/1981 | Eagle | 105/310 |
| 4,508,037 | A | * | 4/1985 | Rousseau | 105/290 |
| 4,601,244 | A | * | 7/1986 | Fischer | 105/240 |
| 4,766,820 | A | * | 8/1988 | Ritter et al. | 105/240 |
| 4,829,908 | A | * | 5/1989 | Hallam | 105/240 |
| 5,249,531 | A | * | 10/1993 | Taylor | 105/290 |

* cited by examiner

*Primary Examiner*—Mark T. Le
(74) *Attorney, Agent, or Firm*—Jerrold J. Litzinger

(57) ABSTRACT

A mechanism for selectively operating hopper doors of a railroad car. A fulcrum coupled to the operating cylinder includes channels within which levers can be selectively activated to open specific doors of the car, thus allowing the contents of the railcar to be sequentially emptied. The mechanism can be installed on railcars having either transverse hopper doors or longitudinal hopper doors.

20 Claims, 16 Drawing Sheets

MECHANISM FOR SELECTIVELY OPERATING HOPPER DOORS OF A RAILROAD CAR

CROSS REFERENCE TO RELATED APPLICATIONS

This application claims benefit from U.S. Provisional Patent Application Ser. No. 60/574,761, filed May 27, 2004, which application is incorporated herein by reference.

BACKGROUND OF THE INVENTION

1. Field of the Invention

The present invention is directed in general to systems for operating railroad car hopper doors, and, in particular, to a system which selectively opens the doors on railroad hopper car doors.

2. Description of the Related Art

A common type of railroad freight car in use today is the freight car of the type wherein the load is discharged through hoppers in the underside of the body. Such cars are generally referred to as hopper cars and are used to haul coal, phosphate and other commodities.

After hopper cars are spotted over an unloading pit, the doors of the hoppers are opened, allowing the material within the hopper to be emptied into the pit.

Hopper cars, which may be covered, are usually found with one of two hopper configurations: transverse, in which the doors closing the hoppers are oriented perpendicular to the center line of the car; or longitudinal, in which the doors closing the hoppers are oriented parallel to the center line of the car. An example of a hopper car with transverse doors is shown in U.S. Pat. No. 5,249,531, while an example of a hopper car with longitudinal doors is shown in U.S. Pat. No. 4,224,877.

Prior art references which teach operating mechanisms for opening and closing hopper doors include U.S. Pat. Nos. 3,596,609; 4,741,274; 3,187,684; 3,611,947; 3,786,764; 3,815,514; 3,818,842; 3,949,681; 4,222,334; 4,366,757; 4,601,244; 5,823,118; and 5,249,531. There are several disadvantages to the hopper door operating mechanisms described in some of the aforementioned patents. One problem is that some of the prior art mechanisms are designed such that each actuating mechanism is connected to doors from two separate hoppers. Thus, if the mechanism fails, it effects the operation of two hoppers. Another disadvantage of some of the above described hopper door mechanisms is that the operating mechanisms limit the distance of the door motion, thus limiting the open area of the car's bottom. This arrangement slows the unloading process and causes additional costs and potential damage to the car due to increased periods in thaw sheds.

Finally, it is often desirable to empty the contents of a railcar while the car is in motion, thus allowing the car to be emptied quicker. Sometimes this is not possible when all of the hopper doors open simultaneously. It is necessary that the doors open in a sequential manner to allow dumping in motion.

SUMMARY OF THE INVENTION

It is therefore an object of the present invention to provide an actuating mechanism which allows the discharge doors of a hopper car to open sequentially.

It is a further object of the present invention to provide an automatic mechanism for actuating the discharge doors of a hopper car which can quickly empty the contents.

It is a still further object of the present invention to provide an actuating mechanism for a hopper car doors which can selectively operate different door sets of the hopper car.

It is a still further object of the present invention to provide an actuating mechanism for a hopper car which can be used on either transverse doors or on longitudinal doors.

These and other objects of the present invention will be more readily apparent from the descriptions and drawings which follow.

DESCRIPTION OF A PREFERRED EMBODIMENT

Figure 1:
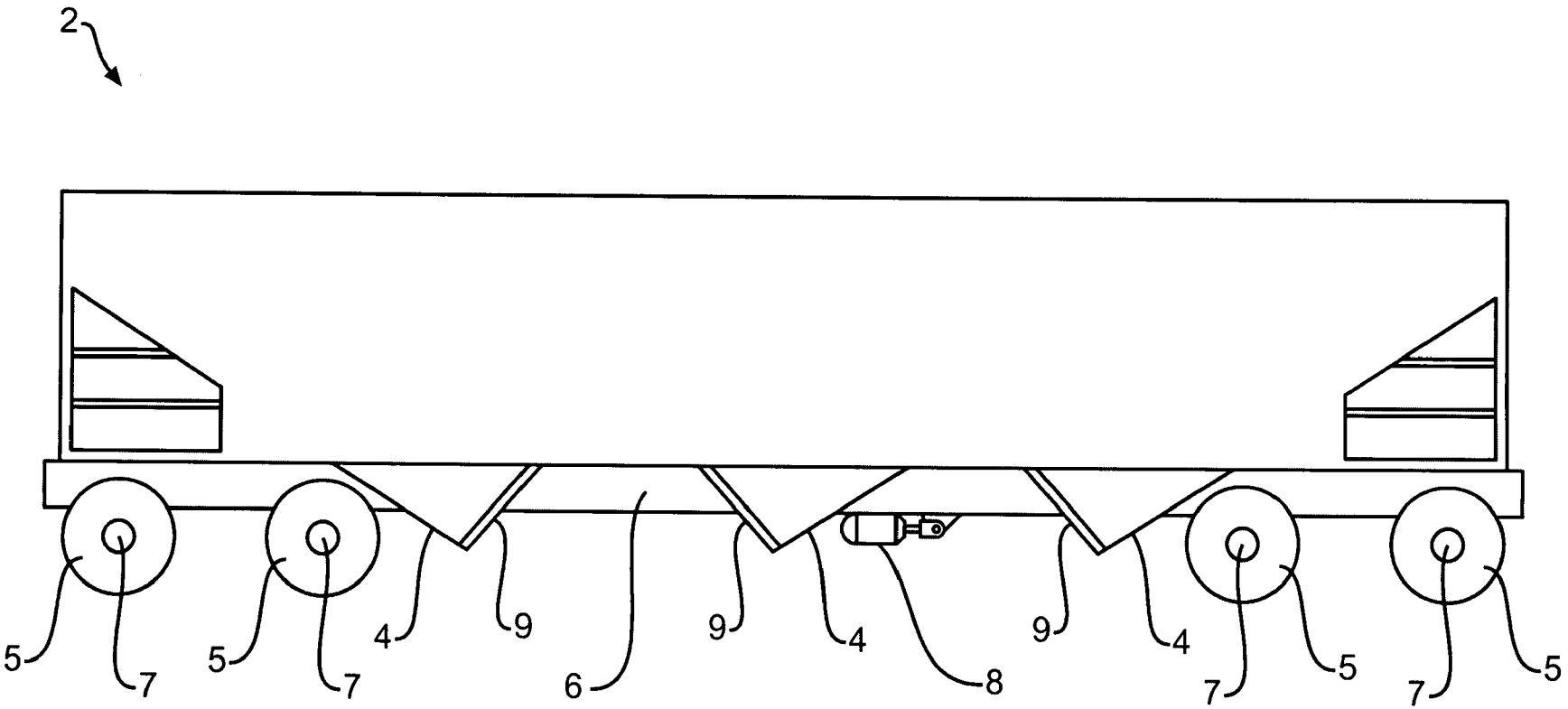
FIG. 1 is an elevational view of a standard three pocket hopper car having a single transverse door associated with each hopper which is capable of using the present invention.
Figure 2:
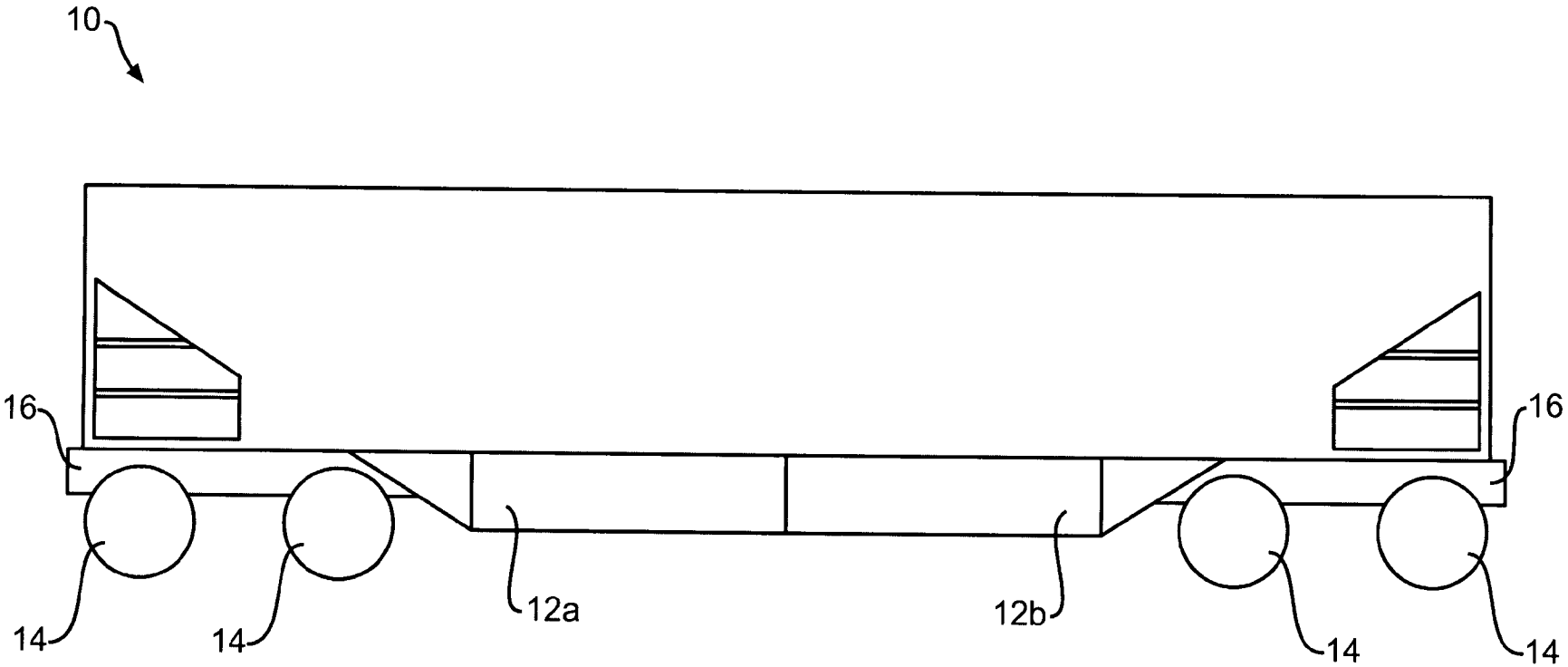
FIG. 2 is an elevational view of hopper car having adjacent longitudinal door sets which is capable of using the present invention.
Figure 3:
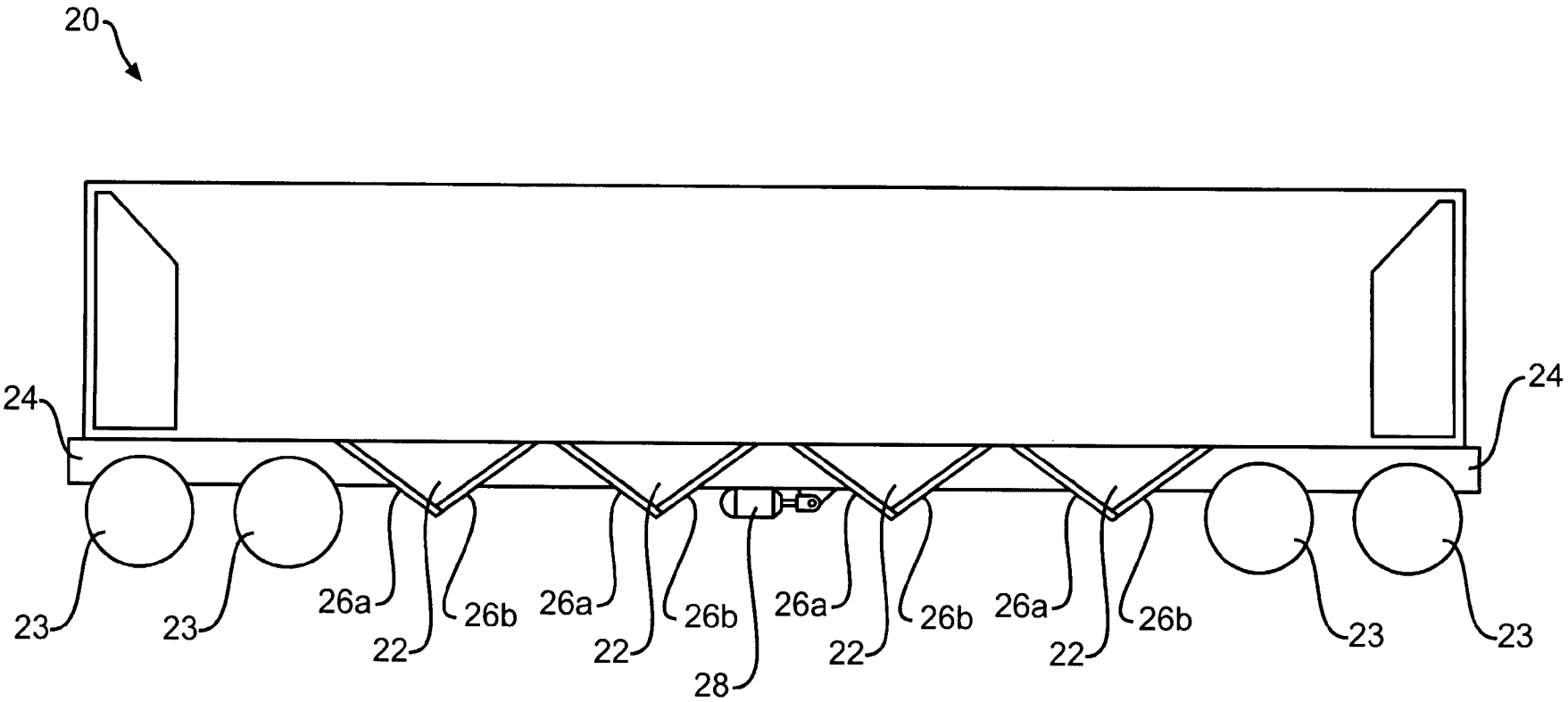
FIG. 3 is an elevational view of a standard four pocket hopper car having transverse doors which is capable of using the present invention.

FIGS. 1-3 display three different major types of hopper cars. FIGS. 1 and 2 show hopper cars using transverse doors, while FIG. 3 shows a car using longitudinal doors.

Referring now to FIG. 1, there is shown a typical three pocket railway hopper car, generally designated at 2, which may be equipped with a preferred embodiment of the present invention. Car 2 is provided with a plurality of hopper units 4, a plurality of wheels 5, and a longitudinally extending center sill 6. Wheels 5 are mounted on a series of truck axles 7. An air cylinder 8 is mounted to car 2 on the underside of sill 6 to provide power for the actuating mechanism for the doors. The operation of air cylinder 8 is well known in the art, and it is within the scope of the present invention to use any suitable power source (electric, liquid, steam) to operate cylinder 8.

Each hopper unit 4 is provided with a door 9 which is moveable to open and close each hopper unit 4. An actuating system for this type of car is taught in U.S. patent application Ser. No. 10/863,887, filed Jun. 8, 2004, now U.S. Pat. No. 7,080,599, which application is incorporated herein by reference.

Referring now to FIG. 2, there is shown a typical hopper railcar, generally indicated at 10, having longitudinal doors which may be equipped with a preferred embodiment of the present invention. Car 10 is provided with a pair of longitudinal door sets 12*a* and 12*b*, a plurality of wheels 14, and a longitudinally extending center sill 16. An operating system for this type of hopper car is taught in U.S. patent application Ser. No. 10/977,008, filed Oct. 29, 2004, now U.S. Pat. No. 6,955,126, which application is incorporated herein by reference. Although the system taught in this application teaches the operation of a single pair of doors, the mechanism can be used to open multiple sets of longitudinal doors.

Referring now to FIG. 3, there is shown a typical four pocket hopper car, generally designated at 20, which may be equipped with a preferred embodiment of the present invention. Car 20 is provided with a plurality of hopper units 22, a plurality of wheels 23, and a longitudinally extending center sill 24. Each of hopper units 22 are covered by a pair of doors 26*a* and 26*b*, and an air cylinder 28 is mounted to car 20 on the underside of center sill 24 to provide power for the actuating mechanism for door sets 26*a*, 26*b*. The actuating mechanism for this type of car is taught in U.S. Pat. No. 5,249,531, which issued Oct. 5, 1993, which patent is incorporated herein by reference.

The mechanism of the present invention can be clearly seen in FIGS. 4A-B and 5A-B. A railcar fitted with the present invention contains a main operating fulcrum 40 which is coupled to a shaft 42 of an operating cylinder (not shown) which supplies the power for actuating the mechanism. Preferably, shaft 42 threadedly engages an opening 43 at one end of fulcrum 40.

FIGS. 12-16 show fulcrum 40 in greater detail. A pair of channels 44, 46 extend along the length of fulcrum 40, forming three elongated sections 48, 50, 52. An aperture 54 is formed through sections 48, 50, 52, while a pair of elongated slots 56, 58 extend along the length of sections 48, 50, 52. Slot 56 extends through section 48 and forms a groove 56*a* within section 50, while slot 58 extends through section 52 and forms a groove 58*a* within section 50. It should be noted that slots 56, 58 in fulcrum 40 have a length that is greater than the distance that shaft 42 of the cylinder travels.

Figure 4A:
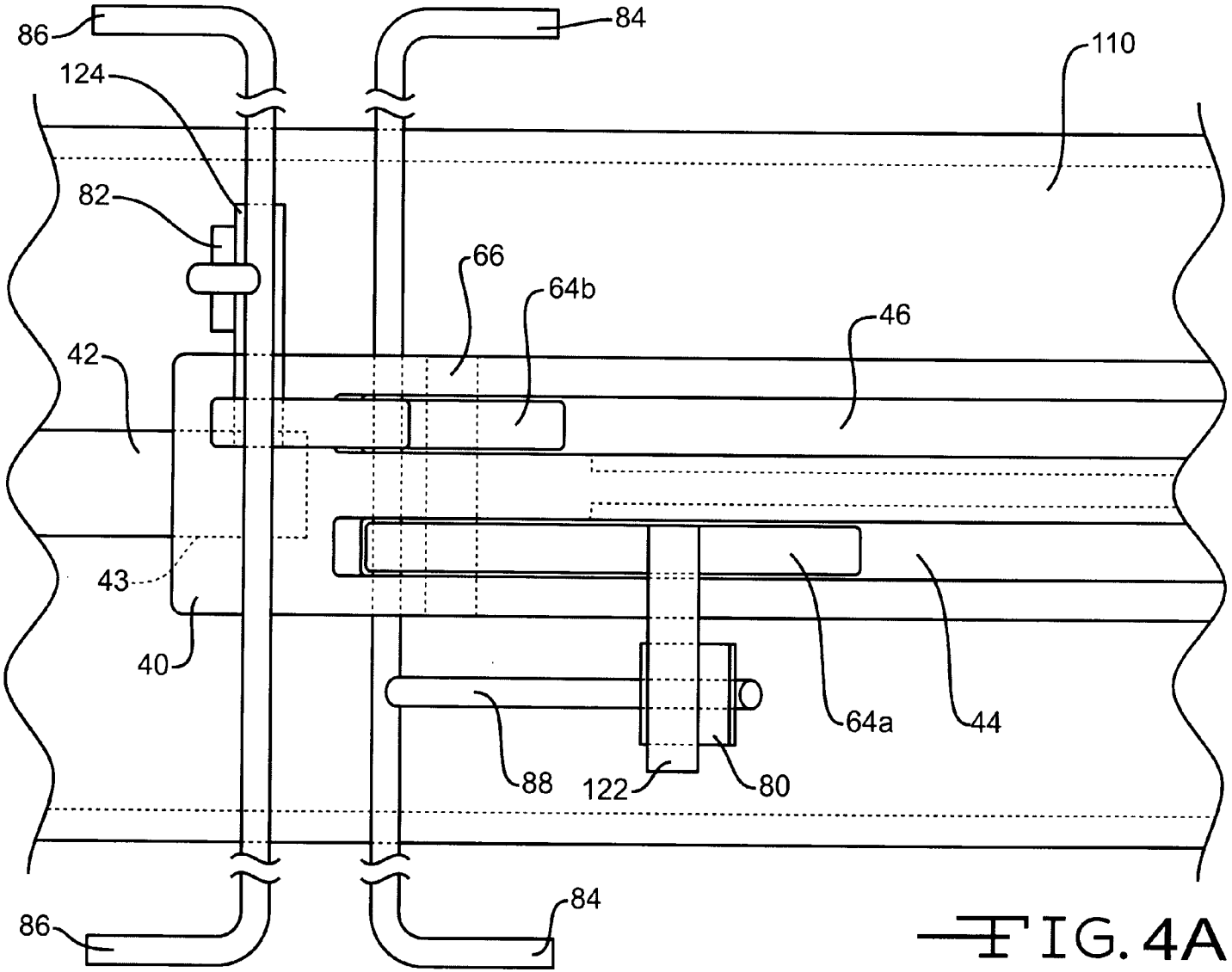
FIGS. 4A-B, taken together, show a top view of the mechanism of the present invention.
Figure 4B:
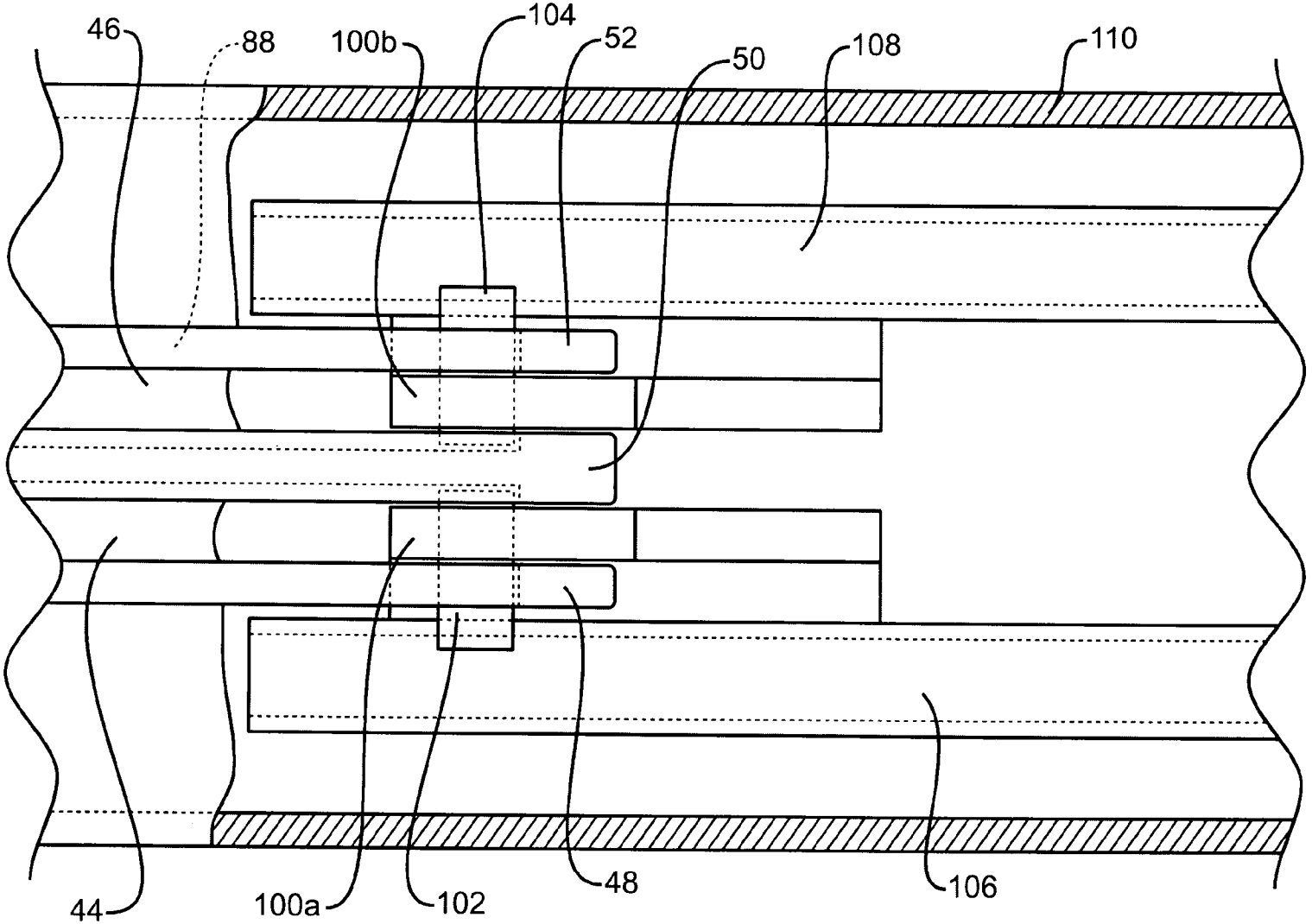

Referring now to FIG. 4A, a pair of identical drive levers 64 are located within channels 44, 46 of fulcrum 40. Levers 64 are coupled for rotation within fulcrum 40 by a pin 66 which passes through an aperture 68 within each lever 64, and also through aperture 54 through sections 48, 50, 52 of fulcrum 40, thus allowing each lever 64 to pivot into and out of channels 44, 46. In the present embodiment, lever 64*a* slides within channel 44 and lever 64*b* slides within channel 46.

A pair of engagement levers 80, 82 are coupled to a pair of operating arms 84, 86 respectively, by sections 88, 90 respectively, which arms extend through the railcar and are accessible on either side thereof. Operating arms 84, 86 rotate to pivot engagement levers 80, 82, and consequentially levers 64*a*, 64*b* between an active engaged position within channels 44, 46 and a disengaged inactive position. Note that levers 80, 82 are slidable along a direction perpendicular to the center line of the railcar.

Figure 7:
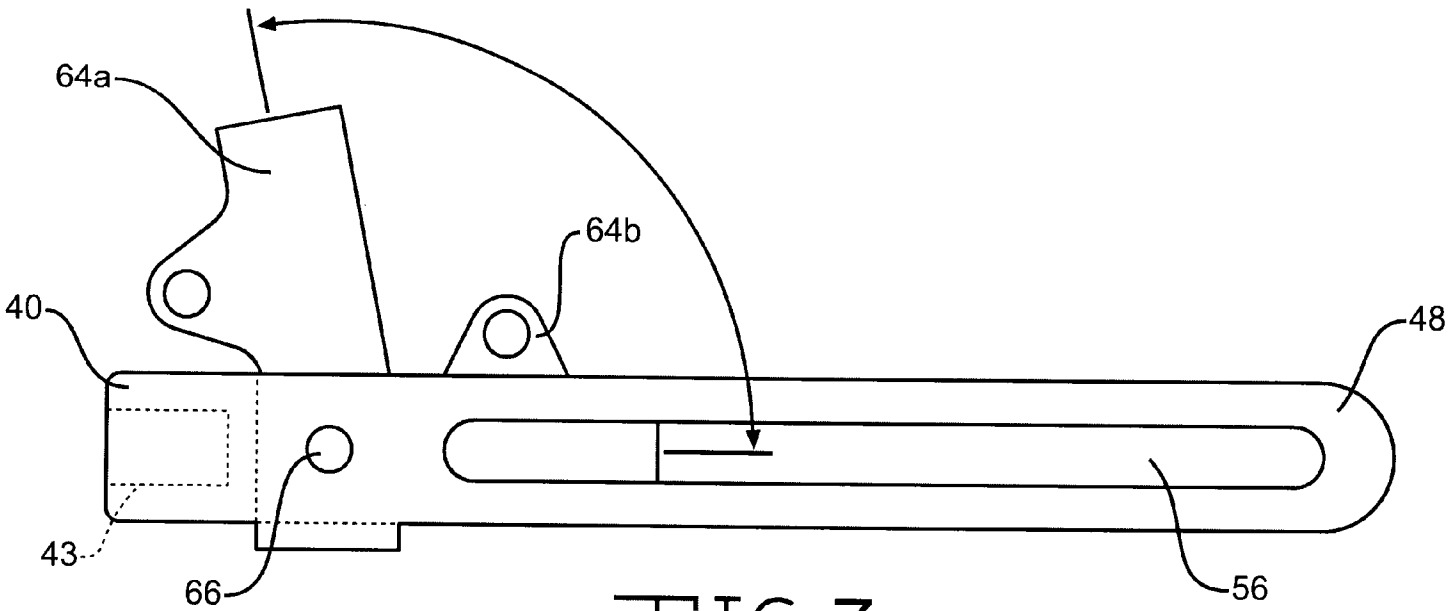
FIG. 7 shows another section of the mechanism in different stages of operation.
Figure 8:
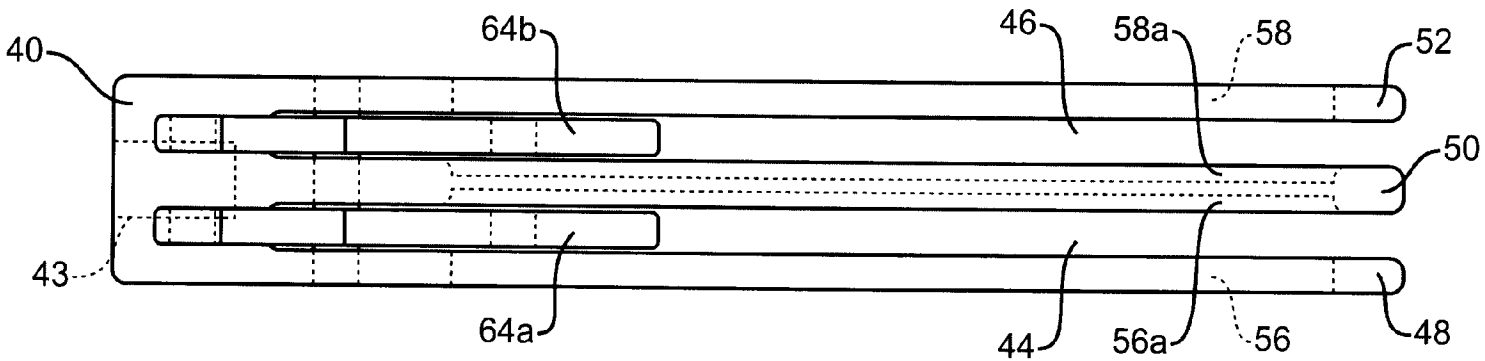
FIG. 8 is a top view of the mechanism of FIG. 7.
Figure 9:
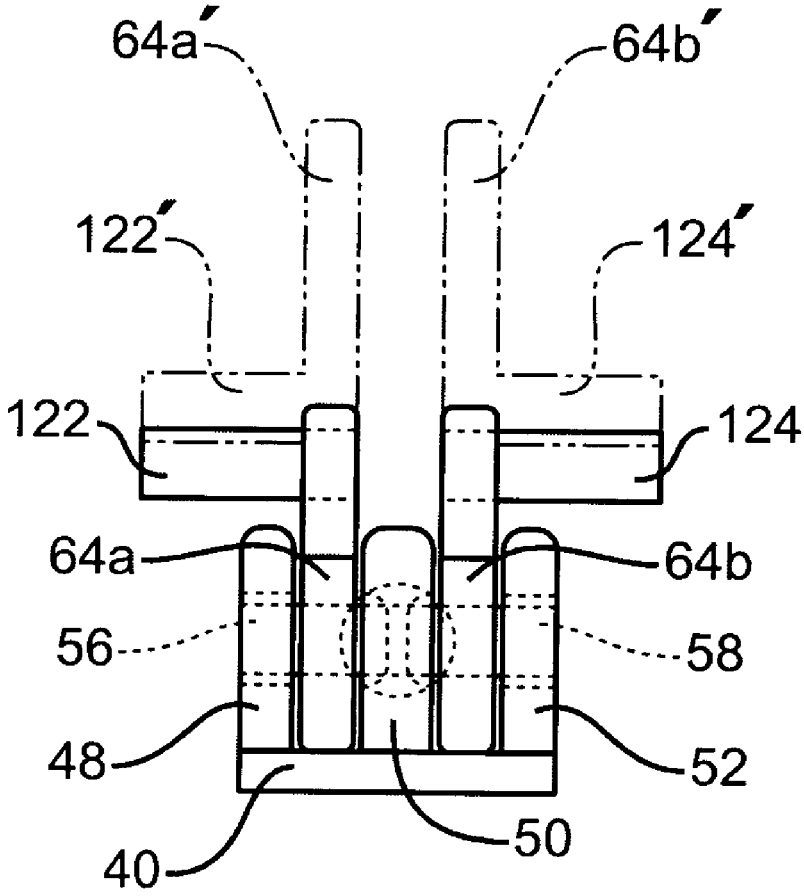
FIG. 9 is an end view of the mechanism shown in FIG. 7.

FIGS. 7, 8, and 9 show fulcrum 40 with levers 64*a*, 64*b* installed. FIG. 7 is a front view which shows lever 64*a* in the vertical deactivated position and lever 64*b* in the horizontal activated position. FIG. 8 is a top view which shows fulcrum 40 with both levers 64*a*, 64*b* in the horizontal activated position. FIG. 9 is an end view which shows both levers 64*a*, 64*b* in the horizontal activated position, while showing the levers in the vertical deactivated position in phantom as lever 64*a*' and lever 64*b*'.

At the opposite end of fulcrum 40, a pair of identical links 100*a*, 100*b* are positioned within channels 44, 46 of fulcrum 40. One link 100*a* is held within channel 44 by a drive pin 102 which travels within slot 56 of section 48 and also within groove 56*a* of section 50. The other link 100*b* is held within channel 46 by a drive pin 104 which travels within slot 58 of section 52 and also within groove 58*a* of section 50. The opposite end of link 100*a* is affixed to a first actuating beam 106, while the opposite end of link 100*b* is affixed to a second actuating beam 108. Beams 106, 108 are located within a center sill 110 of the railcar and are slidable therein to actuate the door operating mechanisms of the car. Fulcrum 40 is located above center sill 110 such that links 100*a*, 100*b* extend downwardly into center sill 110. Levers 64*a*, 64*b* are of sufficient length within channels 44, 46 such that when levers 64*a*, 64*b* are in the horizontal engaged position, movement of fulcrum 40 during the travel of shaft 42 when the air cylinder is activated causes links 100*a*, 100*b* to shift actuating beams 106, 108 to open the hopper doors.

Levers 64*a*, 64*b* each contain an aperture 120. Lever 64*a*, which slides within channel 44, contains an outwardly extending pin 122, fixed within aperture 120, while lever 64*b*, which slides within channel 46, contains an outwardly extending pin 124 fixed within aperture 120. Pins 122 and 124 are engageable by levers 80 and 82 respectively to shift levers 64*a*, 64*b* between the engaged and disengaged positions.

Figure 5A:
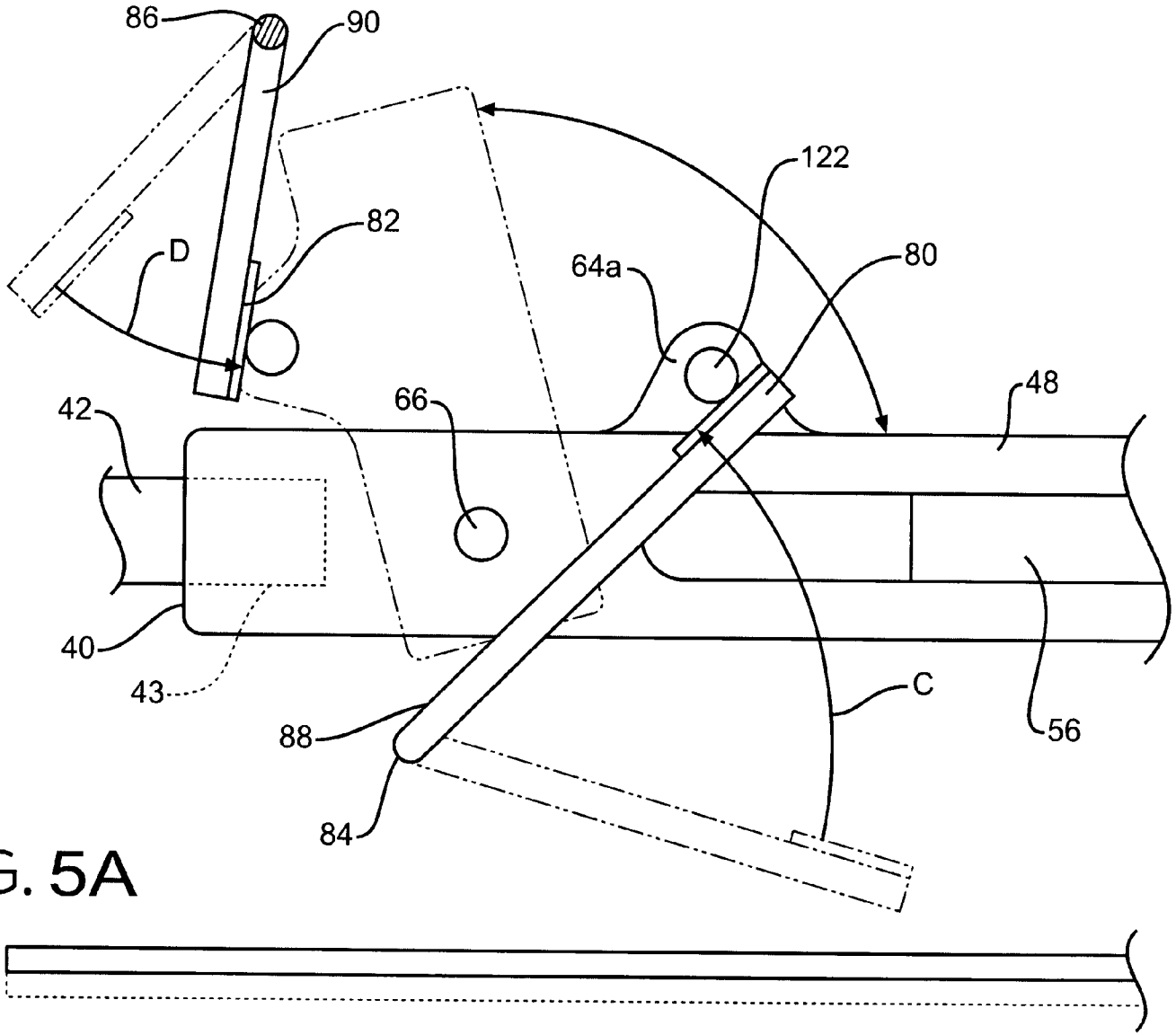
FIGS. 5A-B, taken together, show an elevational view of a section of the mechanism in various stages of operation.
Figure 5B:
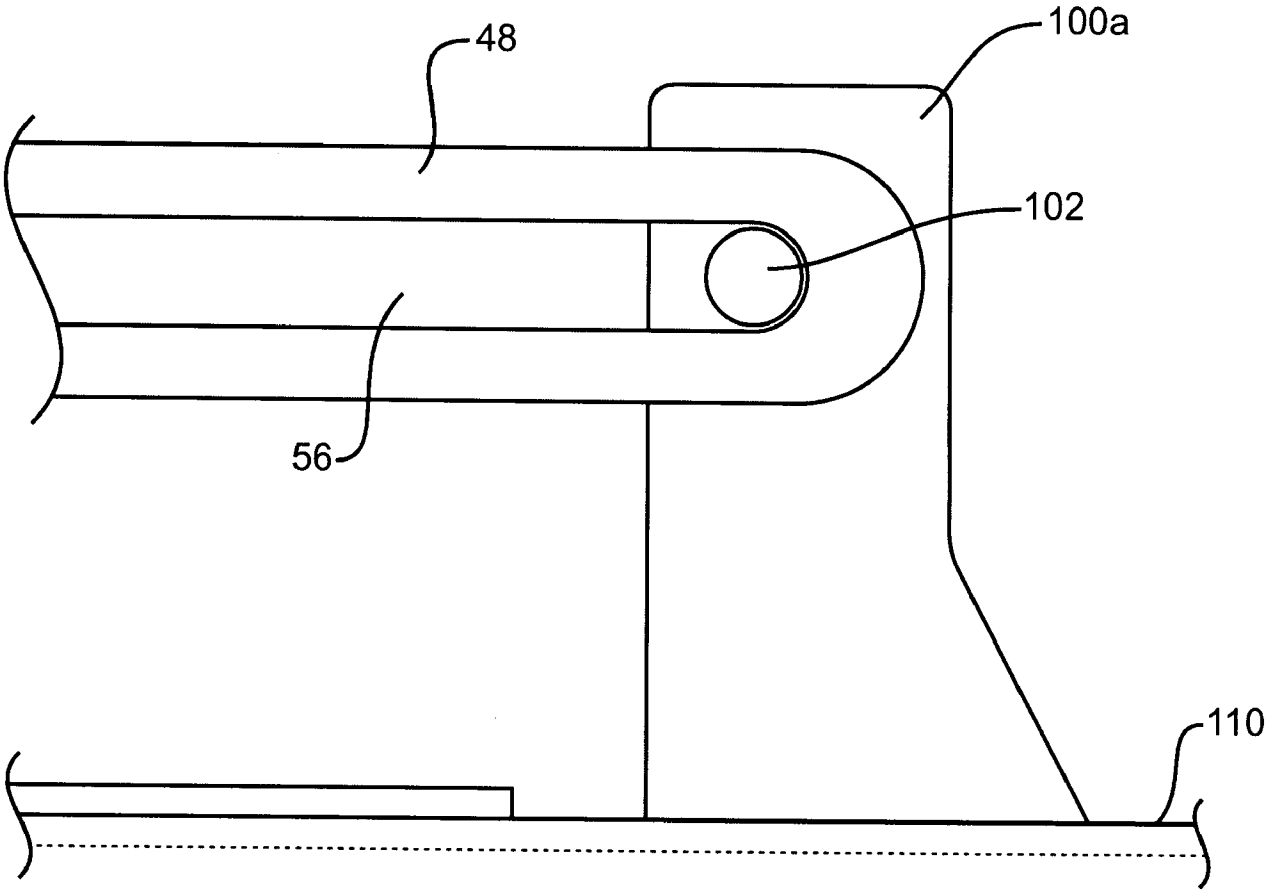
Figure 6:
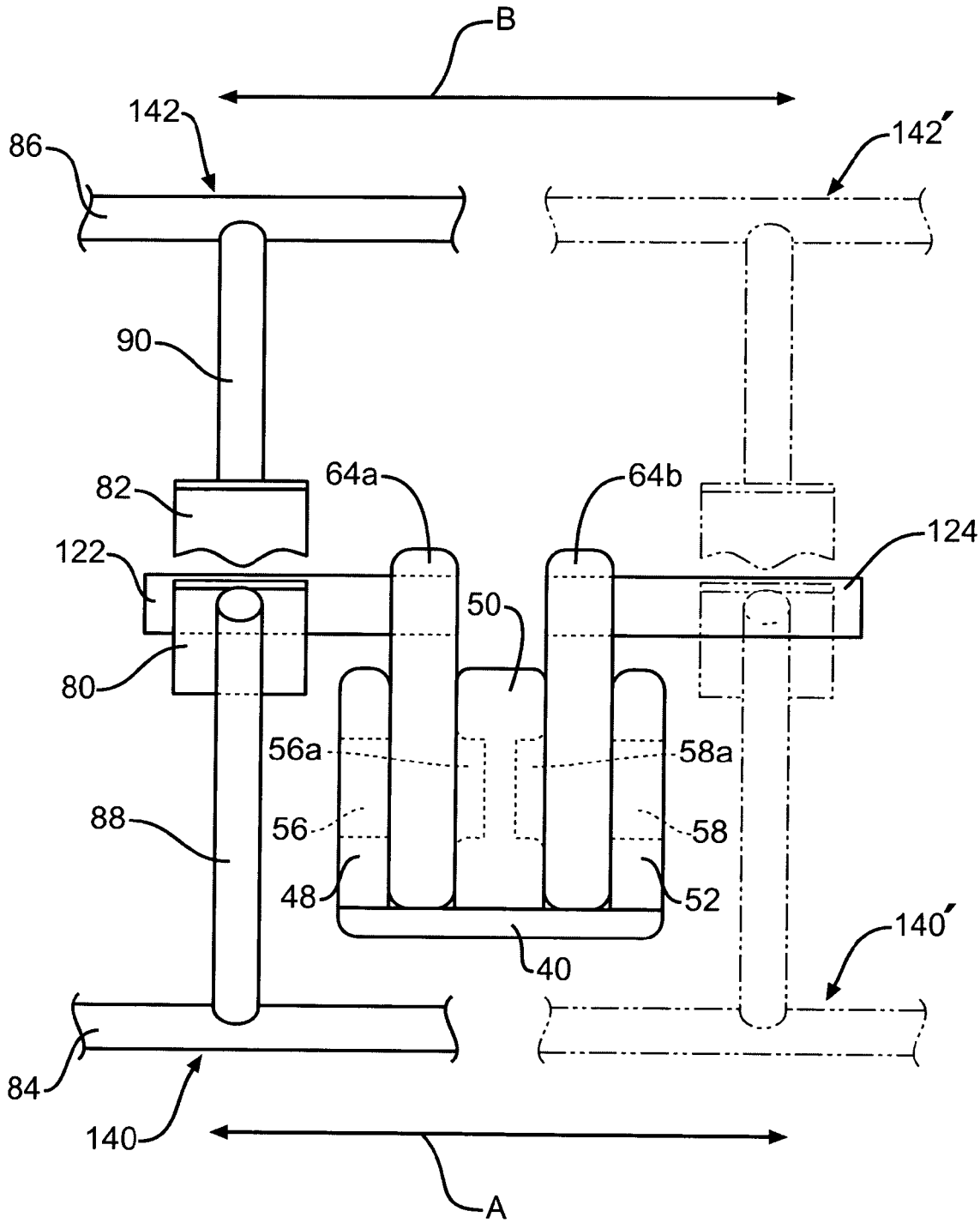
FIG. 6 shows a sectional view of a piece of the mechanism in different positions.

FIG. 6 displays the operating arms shown in FIGS. 4A and 5A in different positions for use in activating and deactivating the present invention. In FIG. 6, both levers 64*a*, 64*b* are shown in the activated position. Engagement lever 80 is shiftable back and forth in the directions shown by arrow A by moving operating arm 84, (which is accessible from either side of the car) while engagement lever 82 is shiftable back and forth in the directions shown by arrow B by moving operating arm 86 (which is accessible from either side of the car). By moving arm 84 to position lever 80 against pin 122 and rotating section 88 in the direction shown by arrow C as shown in FIG. 5A, lever 80 contacts pin 122 and rotates lever 64*a* to its vertical inactive position, which is shown in phantom in FIG. 5A. When it is desired to shift lever 64*a* to its active position, arm 86 is positioned such that lever 82 contacts pin 122, and section 90 is rotated from the position shown in phantom in the direction shown by arrow D by turning arm 86, causing lever 64*a* to rotate about pin 66 to shift to its horizontal active position.

If it is desired to shift lever 64*b* to its inactive position, the assembly containing lever 80, arm 84 and section 88, indicated at 140, is moved beneath fulcrum 40 to the position 140' shown in phantom in FIG. 6 and activated in the direction shown by arrow C in FIG. 5A. To return lever 64*b* to the active position, the assembly containing lever 82, arm 86 and section 90, indicated at 142', is moved above fulcrum 40 to the position 142' shown in phantom in FIG. 6, and activated in the direction shown by arrow D in FIG. 5A.

The operation of the present invention may now be described. When levers 64*a*, 64*b* are in the horizontal active position, the actuating system is fully engaged and when the air cylinder is activated, shaft 42 pushes fulcrum 40 to the right, as viewed in FIG. 4A. As fulcrum 40 travels, lever 64*a* eventually contacts link 100*a*, while lever 64*b* contacts links 100*b*. Continued travel of fulcrum 40 causes actuating beams

106, 108 to move by virtue of attachment of link 100*a* to beam 106 and link 100*b* to beam 108. As the door opening mechanisms are coupled to the actuating beams as taught in U.S. patent application Ser. Nos. 10/863,887 and 10/977,008 and U.S. Pat. No. 5,249,531, the doors of the railcar move from the closed to the open position. Closing of the doors is accomplished by reversing the travel of shaft 42 of the air cylinder. When both levers 42*a*, 42*b* are in the horizontal active position, the car operates as a fully automatic system.

If levers 64*a*, 64*b* are in the vertical deactivated position, when the air cylinder is activated, fulcrum 40 travels to the right, as viewed in FIG. 4A, but the distance of travel of shaft 42 of the air cylinder will not allow levers 64*a*, 64*b* to contact links 100*a* or 100*b*, and the hopper doors remain closed.

To engage the system for opening some of the hopper doors, assembly 142 is shifted to either the right or left as seen in FIG. 6 and arm 86 is rotated such that lever 82 pushes either 64*a* or 64*b* down to the horizontal active position. The air cylinder is then activated, and fulcrum 40 advances to cause either lever 64*a* to contact link 100*a* or lever 64*b* to contact link 100*b*. As fulcrum 40 advances further, either actuating beam 106 or 108 shifts opening the door sets coupled to that beam.

After that portion of the railcar is empty, the operation of the air cylinder is reversed so that fulcrum 40 is retracted to its initial position, closing the doors that had opened. Assembly 140 can be shifted to contact the activated lever, and then arm 84 rotated to cause lever 80 to shift that lever 64 to its vertical deactivated position, disengaging that portion of the opening system. Next, assembly 142 is positioned such that arm 86 may be rotated to cause lever 82 to move the other lever 64 to the horizontal activated position, engaging that portion of the door opening system. The air cylinder is then activated, causing fulcrum 40 to move the active lever 64 into contact with its respective link 100, thus causing the actuating beam to open the remaining hopper doors of the car.

Figure 10A:
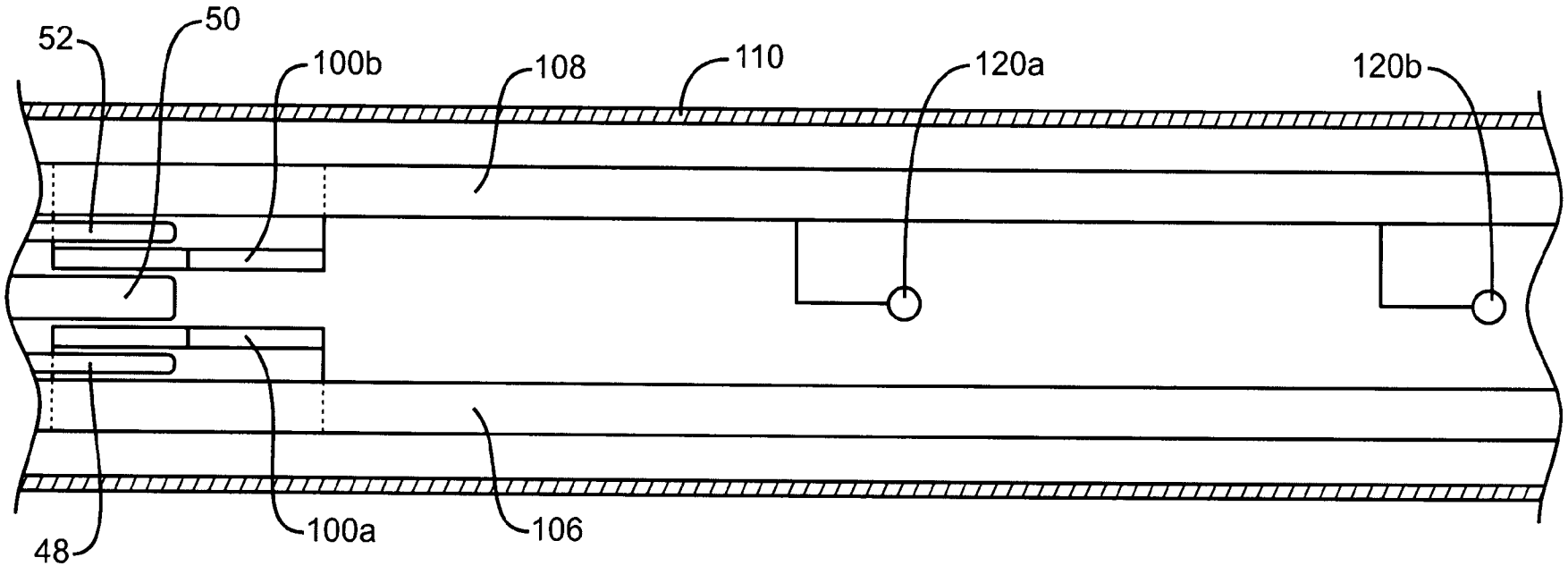
FIGS. 10A-B, taken together, show the mechanism for use in operating longitudinal doors.
Figure 10B:
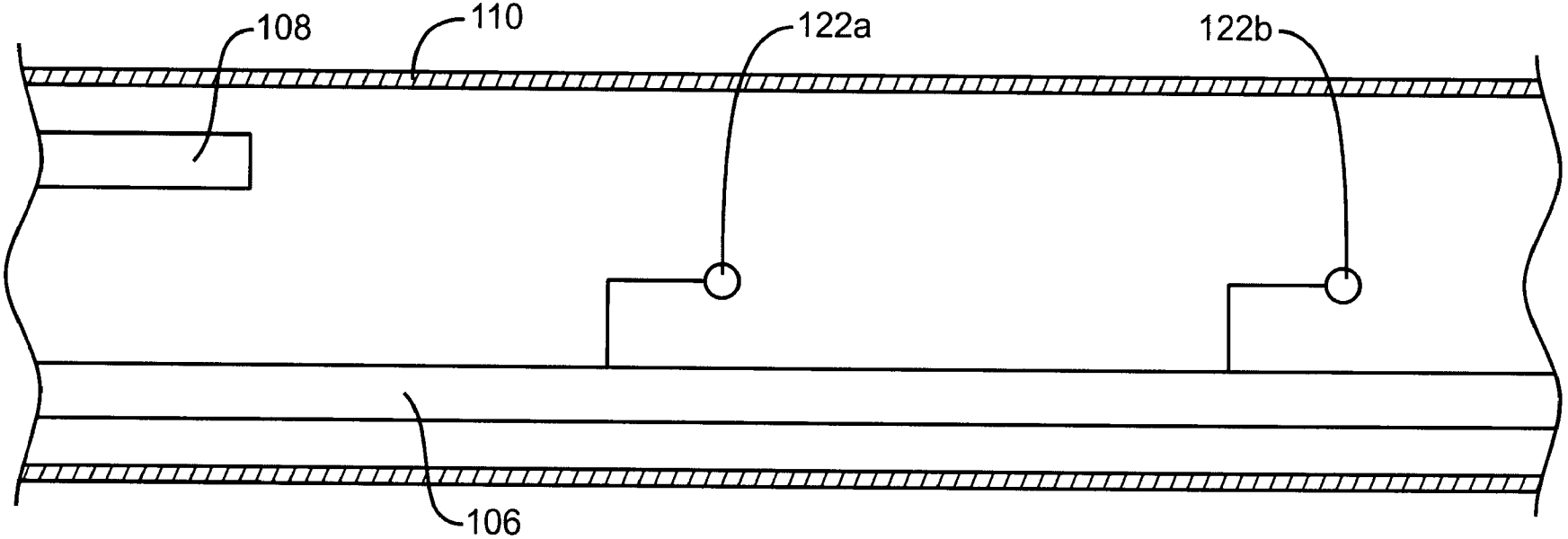

FIGS. 10A-B illustrate the actuating beam connection for use on a hopper car which contains a pair of longitudinal doors. In this system, actuating beam 108 is coupled to activating mechanisms 120*a*, 120*b* for the first set of longitudinal doors which cover a hopper, while actuating beam 106 is coupled to the activating mechanism 122*a*, 122*b* of a second set of longitudinal doors. The activating mechanisms or systems are preferably similar to the one described in U.S. patent application Ser. No. 10/977,008. By using the system of the present invention, the door sets can be opened one at a time, or opened simultaneously.

Figure 11A:
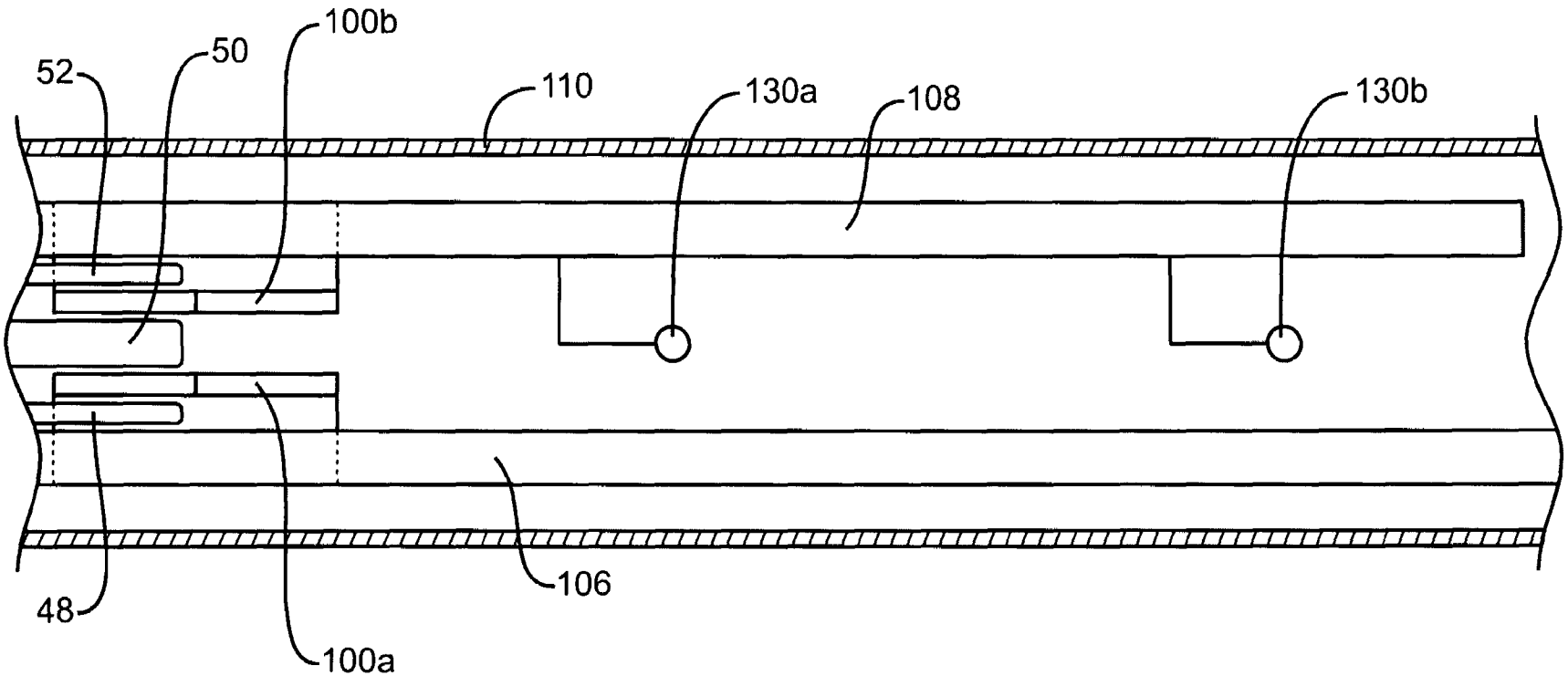
FIGS. 11A-B, taken together, show the mechanism for use in operating transverse doors.
Figure 11B:
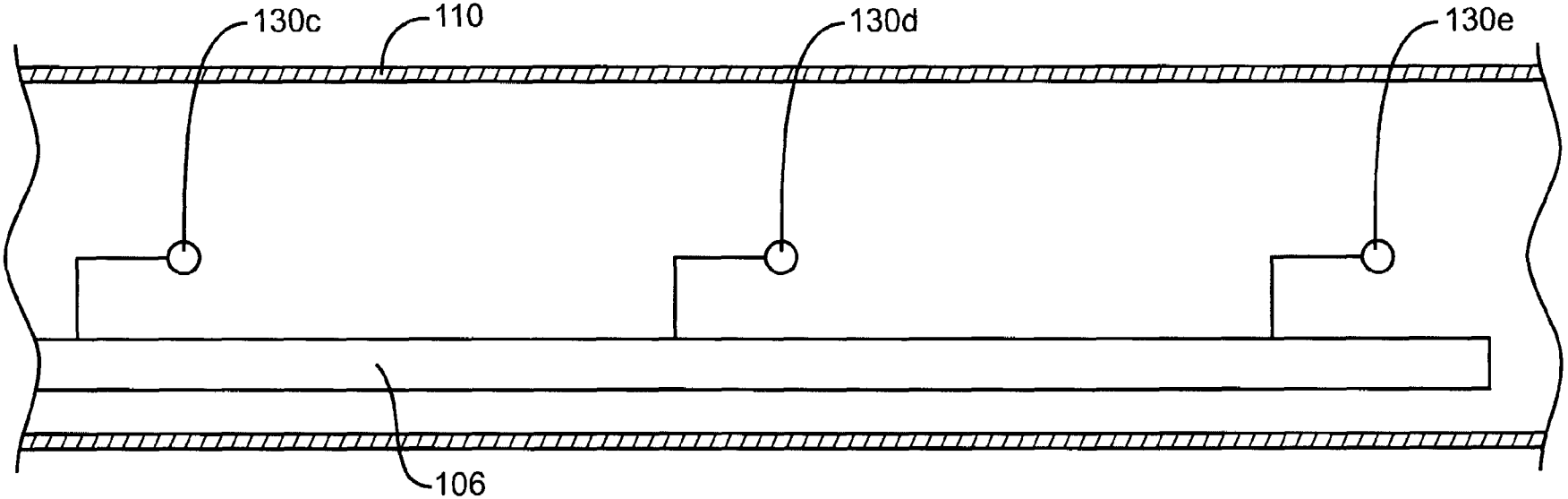
Figure 12:
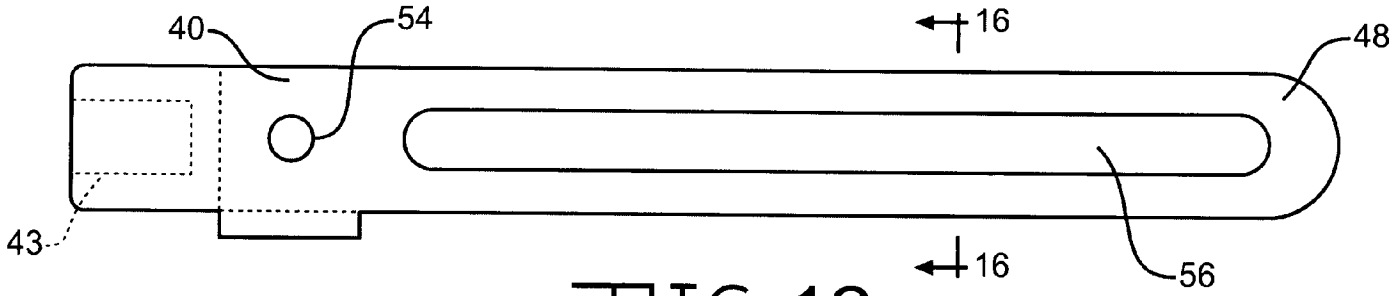
FIG. 12 is a plan view of the fulcrum of the present invention.
Figure 13:
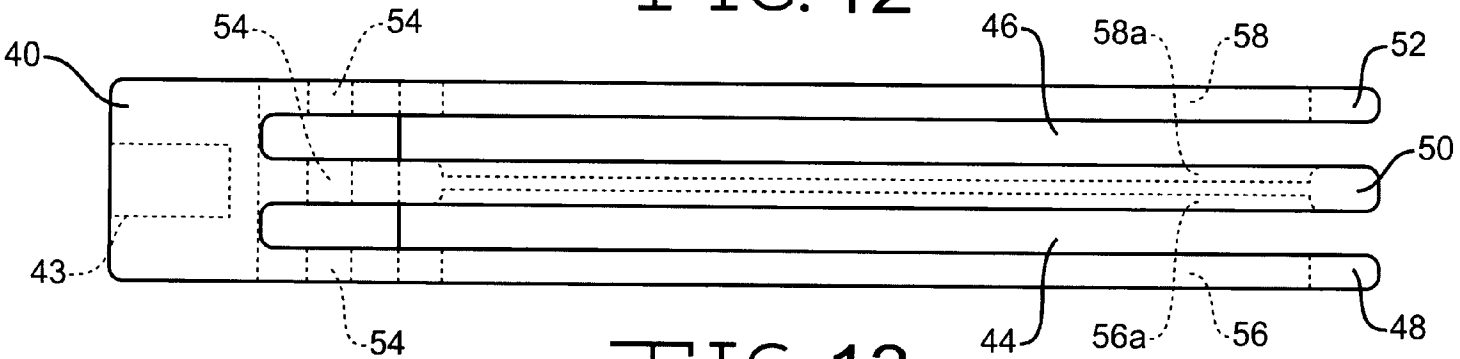
FIG. 13 is a top view of the fulcrum of FIG. 12.
Figure 16:
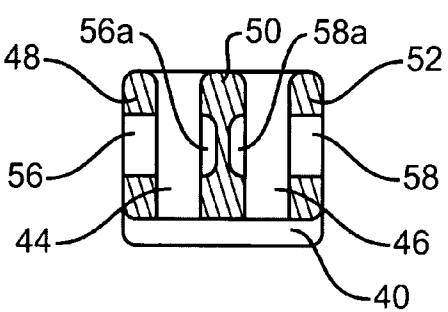
FIG. 16 is a sectional view taken along lines 16-16 of FIG. 12.
Figure 15:
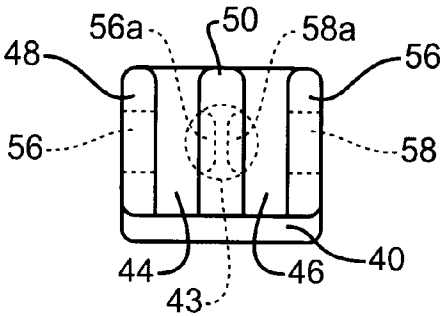
FIG. 15 is the other end view of the fulcrum of FIG. 12.
Figure 14:
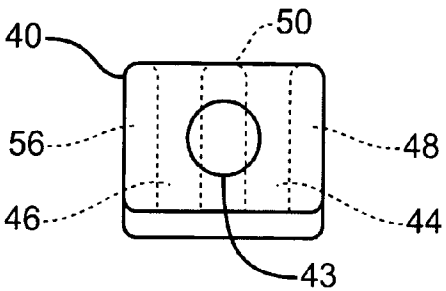
FIG. 14 is an end view of the fulcrum of FIG. 12.
Figure 19:
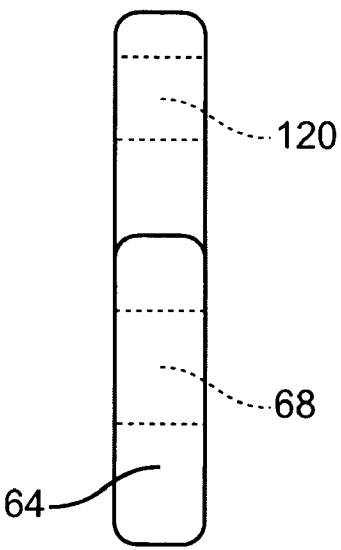
FIG. 19 is an end view of the lever of FIG. 17.
Figure 18:
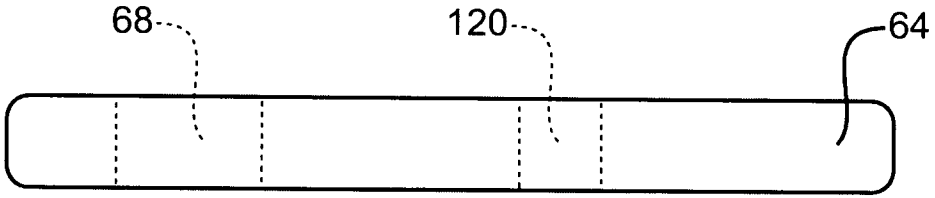
FIG. 18 is a top view of the lever of FIG. 17.
Figure 17:
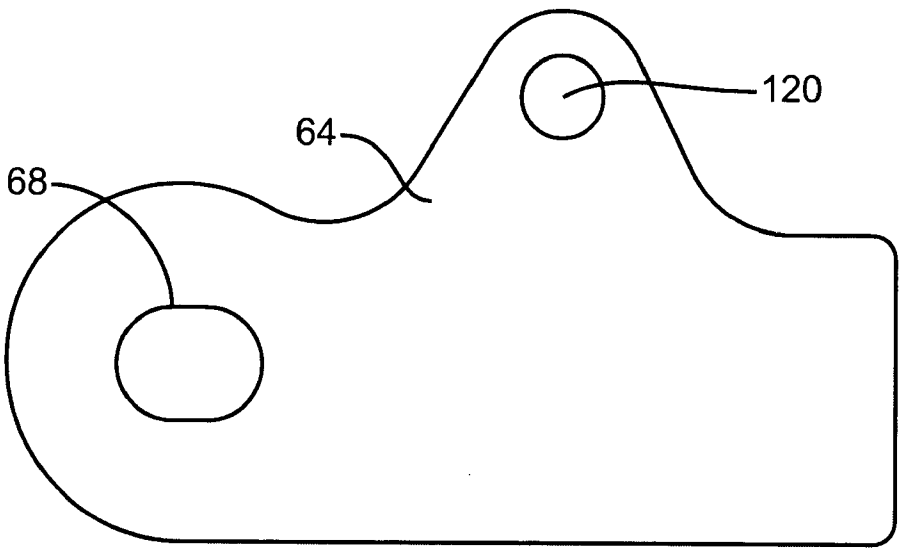
FIG. 17 is a plan view of a lever for use in the present invention.

FIGS. 11A-B illustrate an exemplary actuating beam connection for use on a hopper car which contains a plurality of transverse hoppers. In this system, actuating beam 108 is coupled to activating mechanisms 130*a* and 130*b* which corresponds to two door sets on a hopper car having transverse doors. If each hopper is closed by a set of doors, an activating mechanism or system similar to that taught in U.S. Pat. No. 5,249,531 may be used. If each hopper is closed by only one door, an activating mechanism similar to that taught in U.S. patent application Ser. No. 10/863,887 may be used. Actuating beam 106 is coupled to activating mechanisms 130*c*, 130*d*, and 130*e*. By using this embodiment of the present invention, a number of the hoppers can be emptied at a time, or all of the hoppers may be emptied simultaneously.

In the above description, and in the claims which follow, the use of such words as "clockwise", "counterclockwise", "distal", "proximal", "forward", "outward", "rearward", "vertical", "horizontal", and the like is in conjunction with the drawings for purposes of clarity.

While the invention has been shown and described in terms of preferred embodiments, it will be understood that this invention is not limited to these particular embodiments, and that many changes and modifications may be made without departing from the true spirit and scope of the invention as defined in the appended claims.

What is claimed is:

1. A mechanism for selectively operating hopper doors of a railroad car, comprising:

a power source, shiftable between a first unactuated position and a second actuated position;

a fulcrum, affixed to said power source, comprising a first channel and a second channel;

a first drive lever, located within said first channel and rotatable between an engaged position and a disengaged position;

a second drive lever, located within said second channel and rotatable between an engaged position and a disengaged position;

a first linkage, located within said first channel, contactable by said first drive lever when said first lever is in said engaged position;

a second linkage, located within said second channel, contactable by said second drive lever when said second lever is in said engaged position;

a first actuating beam, affixed to said first linkage and coupled to at least one first hopper door opening mechanism, shiftable between a first position in which said first door opening mechanism is inactive and a second position in which said first door opening mechanism is activated;

and a second actuating beam, affixed to said second linkage and coupled to at least one second hopper door opening mechanism, shiftable between a first position in which said second door opening mechanism is inactive and a second position in which said second door opening mechanism is activated;

wherein when a drive lever is rotated to its engaged position and said power source is actuated, its corresponding linkage is contacted by said drive lever to shift its corresponding actuating beam to its second position, thereby activating its at least one door opening mechanism.

2. The mechanism of claim 1, wherein said power source comprises an air cylinder containing a shaft shiftable between said first unactuated position and said second actuated position.

3. The mechanism of claim 1, further comprising deactivating means for rotating said first and second drive levers from said engaged position to said disengaged position.

4. The mechanism of claim 1, further comprising activating means for rotating said first and second levers from said disengaged position to said engaged position.

5. The mechanism of claim 1, wherein said hopper doors are oriented in the longitudinal direction with respect to the centerline of the railroad car.

6. The mechanism of claim 1, wherein said hopper doors are oriented in the transverse direction with respect to the centerline the railroad car.

7. The mechanism of claim 1, further comprising a center sill extending longitudinally along the underside of the railroad car for containing said first and second actuating beams.

8. The mechanism of claim 3, wherein said deactivating means can be operating from either side of the railroad car.

9. The mechanism of claim 4, wherein said activating means can be operated from either side of the railroad car.

10. The mechanism of claim 3, wherein said deactivating means comprises an engagement lever for contacting a drive lever, an operating arm shiftable in a direction transverse to the railroad car for rotating said engagement lever into contact with said drive lever, and a connecting section coupling said engagement lever to said operating arm.

11. The mechanism of claim 10, wherein said deactivating means is shiftable transversely above said fulcrum.

12. The mechanism of claim 4, wherein said activating means comprises an engagement lever for contacting a drive lever, an operating arm shiftable in a direction transverse to the railroad car for rotating said engagement lever into contact with said drive lever, and a connecting section coupling said engagement lever to said operating arm.

13. The mechanism of claim 12, wherein said activating means is shiftable transversely below said fulcrum.

14. A system for selectively operating hopper doors of a railroad car, said car having opposing sides, comprising:

a powered cylinder having a shaft shiftable between a first unactuated position and a second actuated position;

a fulcrum, affixed to said powered cylinder, comprising;

a first elongated section, a second elongated section, and a central third elongated section located between said first and second sections, a first channel located between said first and third sections, a second channel located between said second and third sections, a first elongated slot through said first section, a first groove within said third section corresponding to said first slot, a second elongated slot through said second section; and a second groove within said first section corresponding to said second slot;

a first drive lever, located within said first channel and rotatable between an engaged position and a disengaged position;

a second drive lever, located within said second channel and rotatable between an engaged position and a disengaged position;

a first linkage, slidably affixed within said first channel by a first pin located within said first slot and said first groove, contactable by said first drive lever when said first lever is in said engaged position;

a second linkage, slidably affixed within said second channel by a second pin located within said second slot and said second groove, contactable by said second drive lever when said second lever is in said engaged position;

a first actuating beam, affixed to said first linkage and coupled to a plurality of first hopper door opening mechanisms, shiftable between a first position in which said first door opening mechanisms are inactive and a second position in which said first door opening mechanisms are activated;

and a second actuating beam, affixed to said second linkage and coupled to a plurality of second hopper door opening mechanisms, shiftable between a first position in which said second door opening mechanisms are inactive and a second position in which said second door opening mechanisms are activated;

wherein when a drive lever is rotated to its engaged position and said powered cylinder is actuated, its corresponding linkage is contacted by said drive lever to shift its corresponding actuating beam to its second position, thereby activating said door opening mechanisms.

15. The system of claim 14, further comprising deactivating means for rotating said first and second drive levers from said engaged position to said disengaged position.

16. The system of claim 14, further comprising activating means for rotating said first and second levers from said disengaged position to said engaged position.

17. The system of claim 15, wherein said deactivating means comprises an engagement lever for contacting a drive lever, an operating arm shiftable in a direction transverse to the railroad car for rotating said engagement lever into contact with said drive lever, and a connecting section coupling said engagement lever to said operating arm.

18. The system of claim 17, wherein said deactivating means is shiftable transversely above said fulcrum.

19. The system of claim 16, wherein said activating means comprises an engagement lever for contacting a drive lever, an operating arm shiftable in a direction transverse to the railroad car for rotating said engagement lever into contact with said drive lever, and connecting section coupling said engagement lever to said operating arm.

20. The system of claim 19, wherein said activating means is shiftable transversely below said fulcrum.

* * * * *